US011008791B2

(12) United States Patent
Rupp et al.

(10) Patent No.: US 11,008,791 B2
(45) Date of Patent: May 18, 2021

(54) GUIDE SYSTEM FOR FURNITURE PARTS

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT); Franz Kohlweiss, Hard (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/444,320

(22) Filed: Jun. 18, 2019

(65) Prior Publication Data

US 2019/0301218 A1 Oct. 3, 2019

Related U.S. Application Data

(63) Continuation of application No. PCT/AT2018/060003, filed on Jan. 8, 2018.

(30) Foreign Application Priority Data

Jan. 13, 2017 (AT) ..... A 50022/2017

(51) Int. Cl.
*E05D 15/58* (2006.01)
*E06B 3/50* (2006.01)
(Continued)

(52) U.S. Cl.
CPC ..... *E05D 15/58* (2013.01); *E05D 15/264* (2013.01); *E05F 1/08* (2013.01); *E05F 5/00* (2013.01);
(Continued)

(58) Field of Classification Search
CPC . E05D 15/58; E05D 15/264; E05D 2015/586; E06B 3/482; E06B 3/5045;
(Continued)

(56) References Cited

U.S. PATENT DOCUMENTS 4,821,375 A * 4/1989 Kozon ..... E05D 15/58 16/360
5,020,868 A 6/1991 Brunnert
(Continued)

FOREIGN PATENT DOCUMENTS

AT 516282 B1 * 4/2016 ..... E05D 15/264
CN 104080992 10/2014
(Continued)

OTHER PUBLICATIONS

Machine translation for DE29710854 (Year: 1997).*
(Continued)

*Primary Examiner* — Hiwot E Tefera
(74) *Attorney, Agent, or Firm* — Wenderoth, Lind & Ponack, L.L.P.

(57) ABSTRACT

A guide system includes a first guide rail and a second guide rail for guiding furniture parts. The second guide rail extends transversely relative to the first guide rail in a mounted position. A guiding device is to be connected to one of the furniture parts, and is movable relative to the first and second guide rails and can be transferred in a crossing region between the first and second guide rail. The guide system has a drive device with an entrainment member acted upon by a force storage member and configured to be releasably coupled to the guiding device. The entrainment member is locked in a parking position and can be unlocked by an entry of the guiding device into the crossing region. Thus, the entrainment member and the guiding device coupled therewith can be retracted along the second guide rail by a force of the force storage member.

16 Claims, 13 Drawing Sheets

(51) Int. Cl.

| | |
|---|---|
| ***E05D 15/26*** | (2006.01) |
| ***E06B 3/48*** | (2006.01) |
| ***E05F 5/00*** | (2017.01) |
| ***E05F 1/08*** | (2006.01) |
| *E05F 1/16* | (2006.01) |

(52) U.S. Cl.
CPC ..... *E06B 3/482* (2013.01); *E06B 3/5045* (2013.01); *E05F 1/16* (2013.01); *E05Y 2201/638* (2013.01); *E05Y 2900/20* (2013.01); *E05Y 2900/212* (2013.01)

(58) Field of Classification Search
CPC ..... E05Y 2900/20; E05Y 2900/212; E05Y 2900/14; E05Y 2201/638; E05F 1/08; E05F 5/00; E05F 1/16; A47B 88/467
USPC ..... 312/322, 326, 323, 319.2, 319.1
See application file for complete search history.

(56) References Cited

U.S. PATENT DOCUMENTS

| | | | | |
|---|---|---|---|---|
| 5,072,768 | A | 12/1991 | Bonetti et al. | |
| 5,131,449 | A * | 7/1992 | Winn | E05D 15/264 160/199 |
| 5,207,781 | A | 5/1993 | Röck | |
| 6,318,824 | B1 * | 11/2001 | LaGrotta | E05D 3/022 312/322 |
| 7,322,661 | B1 * | 1/2008 | Salvesen | A47B 47/02 292/146 |
| 9,068,386 | B2 | 6/2015 | Ishii et al. | |
| 9,894,996 | B1 * | 2/2018 | Grela | E06B 3/5045 |
| 10,227,806 | B2 | 3/2019 | Gabl | |
| 10,400,493 | B2 | 9/2019 | Gabl | |
| 10,753,133 | B2 | 8/2020 | Kohlweiss | |
| 2004/0252045 | A1 * | 12/2004 | Wu | E05D 15/58 341/176 |
| 2007/0159037 | A1 * | 7/2007 | Hoffman | E05D 15/58 312/322 |
| 2008/0218043 | A1 * | 9/2008 | Gianelo | A47B 43/00 312/319.2 |
| 2013/0232878 | A1 * | 9/2013 | Bortoluzzi | E05F 5/00 49/252 |
| 2013/0292067 | A1 * | 11/2013 | Lucas | E06B 9/0638 160/213 |
| 2015/0008811 | A1 * | 1/2015 | Ishii | E05D 15/58 312/322 |
| 2017/0241178 | A1 | 8/2017 | Gabl | |
| 2017/0260789 | A1 | 9/2017 | Gabl | |
| 2018/0119470 | A1 | 5/2018 | Kohlweiss | |
| 2020/0018108 | A1 * | 1/2020 | Sperger | E05D 15/58 |

FOREIGN PATENT DOCUMENTS

| | | |
|---|---|---|
| DE | 39 42 518 | 7/1990 |
| DE | 297 10 854 | 10/1997 |
| EP | 0 329 123 | 8/1989 |
| EP | 0 433 726 | 7/1992 |
| EP | 0 391 221 | 9/1995 |
| JP | 61-33811 | 10/1986 |
| JP | 5587502 | 8/2014 |
| WO | 2016/081961 | 6/2016 |
| WO | 2016/081963 | 6/2016 |
| WO | 2017/000006 | 1/2017 |

OTHER PUBLICATIONS

International Search Report dated Apr. 9, 2018 in International (PCT) Application No. PCT/AT2018/060003.
Search Report dated Nov. 10, 2017 in Austrian Application No. A 50022/2017, with English translation.
English translation of Search Report dated May 26, 2020 in Chinese Application No. 201880006712.0.

* cited by examiner

GUIDE SYSTEM FOR FURNITURE PARTS

BACKGROUND OF THE INVENTION

The present invention relates to a guide system for guiding a movably-supported first furniture part, in particular a first door wing of a folding door, which is hingedly connected to at least one second furniture part, in particular a second door wing of a folding door. The guide system includes a first guide rail for guiding the furniture parts, a second guide rail for guiding the furniture parts, wherein the second guide rail, in the mounting position, extends transversely relative to the first guide rail, and a guiding device to be connected to one of the furniture parts. The guiding device is movable relative to the first and second guide rail, and can be transferred in a crossing region—seen in a top view onto the first and second guide rail in the mounting position—to and from between the first and second guide rail.

The invention further concerns an arrangement comprising two furniture parts hingedly connected to one another, in particular door wings of a folding door, and a guide system of the type to be described. The invention further concerns an item of furniture having such an arrangement or having such a guide system.

EP 0 433 726 B1 shows a rail arrangement for guiding cabinet doors which are hingedly connected to one another by a vertically extending pivoting axis in the mounting position. By the rail arrangement, the cabinet doors are movably supported between a first position, in which the cabinet doors are aligned coplanar to one another, and a second position, in which the cabinet doors are arranged parallel to one another. The cabinet doors, in the second position, are accommodated within a lateral insertion gap. The rail arrangement includes a first guide rail extending parallel to a front side of the cabinet, and a second guide rail arranged at a right angle to the first guide rail. Moreover, a carrier (reference number 5 in FIG. 1) is provided on which a first cabinet door is hingedly supported, the carrier being displaceable via guide rails in a horizontal direction in a direction parallel to an outer wall of the cabinet, so that the two cabinet doors can be pushed into the insertion gap. A guide element (reference number 7) is arranged on the second cabinet door, the guide element being configured to be displaced along the first guide rail. A drawback of this construction is the fact that the guide element, upon the right-angled transition between the first and second guide rail, can collide with the U-shaped limbs of the guide rails. As a result, the insertion movement of the guide element into the guide rails is impeded.

WO 2016/081963 A1, WO 2016/081961 A1 and DE 297 10 854 U1 disclose guide systems for door wings which are hingedly connected to one another. The door wings, in a folded-together position, can be pushed into a cabinet compartment of the furniture carcass by applying a manual pressure to the door wings. Depending on the size and on the weight of the door wings, a relatively large manual effort is required for this purpose.

It is an object of the present invention to propose a guide system mentioned in the introductory part, thereby avoiding the drawback as discussed above.

SUMMARY OF THE INVENTION

According to the invention, the guide system has a drive device with an entrainment member which is acted upon by at least one force storage member and which is configured to be releasably coupled to the guiding device. The entrainment member is locked in a parking position, and the entrainment member can be unlocked by an entry of the guiding device into the crossing region, so that the entrainment member, together with the guiding device coupled therewith, can be retracted at least over a region along the second guide rail by a force of the at least one force storage member.

By the proposed guide system, at least two furniture parts which are hingedly connected to one another by a pivoting axis, can be moved between a first position, in which the furniture parts are aligned substantially coplanar to one another, and a second position, in which the furniture parts are folded together and thereby adopt a substantially parallel position to one another. The furniture parts, upon a transition from the first guide rail to the second guide rail, can be moved by the drive device along the second guide rail, and, if appropriate, can be retracted at least over a region into a lateral insertion compartment of an item of furniture. The drive device can be configured so as to operate exclusively mechanically, i.e. without electrical drives and without other electrical components, respectively.

BRIEF DESCRIPTION OF THE DRAWINGS

Further details and advantages of the present invention will be explained with the aid of the following description of figures, in which.

DETAILED DESCRIPTION OF THE INVENTION

Figure 13A:
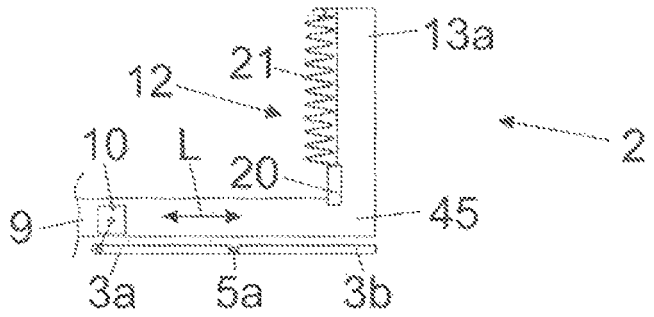
FIG. 13*a*-13*d* show schematic views of the guide system and a chronological sequence of the movements performed by the furniture parts.

The general basic principle of the invention will be explained with the aid of FIGS. 13*a*-13*d* which, in each case, shows a top view onto the guide system 2. The guide system 2 includes a first guide rail 9 having a longitudinal axis (L) and a second guide rail 13*a* for guiding at least two furniture parts 3*a*, 3*b* which are hingedly connected to one another by a vertically extending pivoting axis 5*a*. The second guide rail 13*a* extends transversely, preferably at a right angle, to the first guide rail 9. A guiding device 10 (for example, a running carriage having a plurality of running rollers) configured to be connected to the first furniture part 3*a* is movably supported along the first guide rail 9 in the longitudinal direction (L). In FIG. 13*a*, the furniture parts 3*a*, 3*b* adopt a first position in which the furniture parts 3*a*, 3*b* are aligned substantially coplanar to one another. The guide system 2 comprises a drive device 12 with a movably-supported entrainment member 20 configured to be releasably coupled to the guiding device 10. The entrainment member 20, in the parking position as shown in FIG. 13*a*, is pre-stressed by at least one force storage member 21. The entrainment member 20, in the shown parking position in which the force storage member 21 is loaded, is releasably locked, so that a movement of the entrainment member 20 in a direction transverse to the longitudinal direction (L) is prevented. This locking of the entrainment member 20 can be effected, for example, by a separate locking device 30 (see FIG. 7*a*, 7*b*) or also without the aid of a separate device, in particular by the geometrical provision of a guide track cooperating with the force storage member 21 in order to obtain a self-locking arrested parking position of the entrainment member 20 (for example with the aid of a curved-shaped or edge-shaped section of the guide track, as shown in EP 391 221 B1).

Figure 13B:
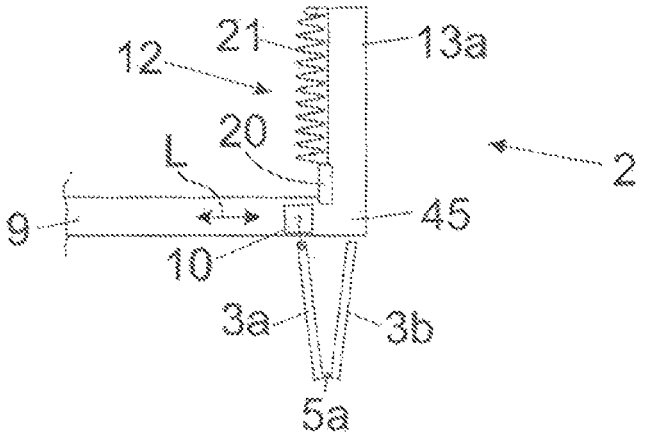
Figure 13C:
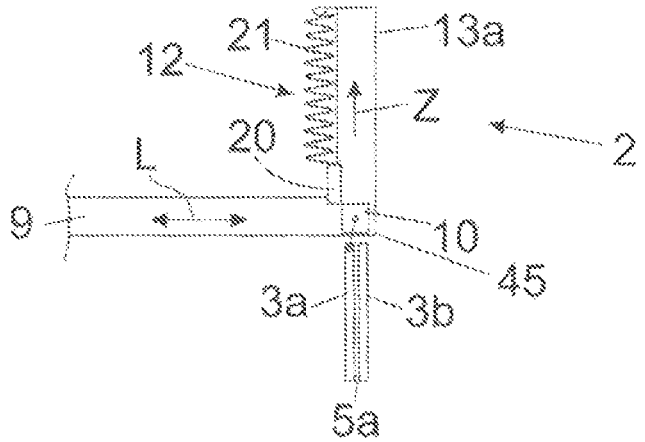
Figure 13D:
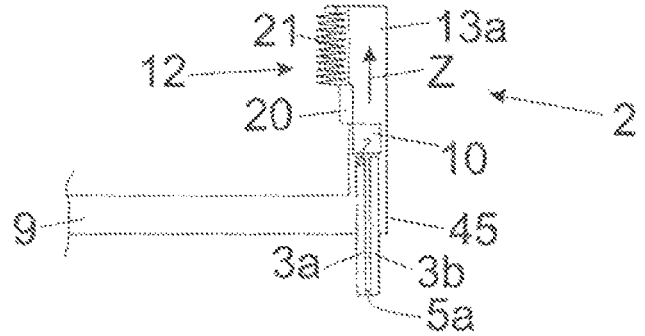

Starting from FIG. 13*a*, the furniture parts 3*a*, 3*b* can be moved about the pivoting axis 5*a* into an angled position relative to one another, and the guiding device 10 is moved in the longitudinal direction (L) of the first guide rail 9 (FIG. 13*b*). The furniture parts 3*a*, 3*b* can then be moved into a second position in which the furniture parts 3*a*, 3*b* are aligned substantially parallel to one another (FIG. 13*c*). The entrainment member 20 can be unlocked by an entry of the guiding device 10 in a crossing region 45, seen in a top view onto the two guide rails 9, 13*a*, and can be coupled to the guiding device 10, so that the entrainment member 20, together with the guiding device 10 coupled therewith, can be retracted at least over a region along the second guide rail 13*a* in the direction (Z) by a force of the discharging force storage member 21 (FIG. 13*d*). This retraction movement can be effected until reaching a predetermined end position of the furniture parts 3*a*, 3*b* or can also be configured as a partial retraction. With such a partial retraction, it is namely possible that the at least one force storage member 21 of the drive device 12, after retracting the entrainment member 20, can be again loaded by a continued manual application of force in the direction (Z) until the end position of the furniture parts 3*a*, 3*b*, so that the entrainment member 20 (and therewith the furniture parts 3*a*, 3*b*) can be driven, starting from the end position, at least over a region in a direction opposite the direction (Z).

The first guide rail 9, together with the second guide rail 13*a*, can have a one-piece configuration, and the first guide rail 9 and the second guide rail 13*a* can be connected to one another by a curved-shaped section. Alternatively, it can be provided that the first guide rail 9 and the second guide rail 13*a* are configured as separate components which, in the mounting position, can either adopt a same or also a different height position. The crossing region 45 results, in a top view, from that region in which the guide rails 9, 13*a* or notional extensions of the guide rails 9, 13*a* intersect with one another (i.e., a region where a longitudinal axis of the first guide rail 9 intersects a longitudinal axis of the second guide rail 13*a* when viewed from above in a top or plan view).

Figure 1B:
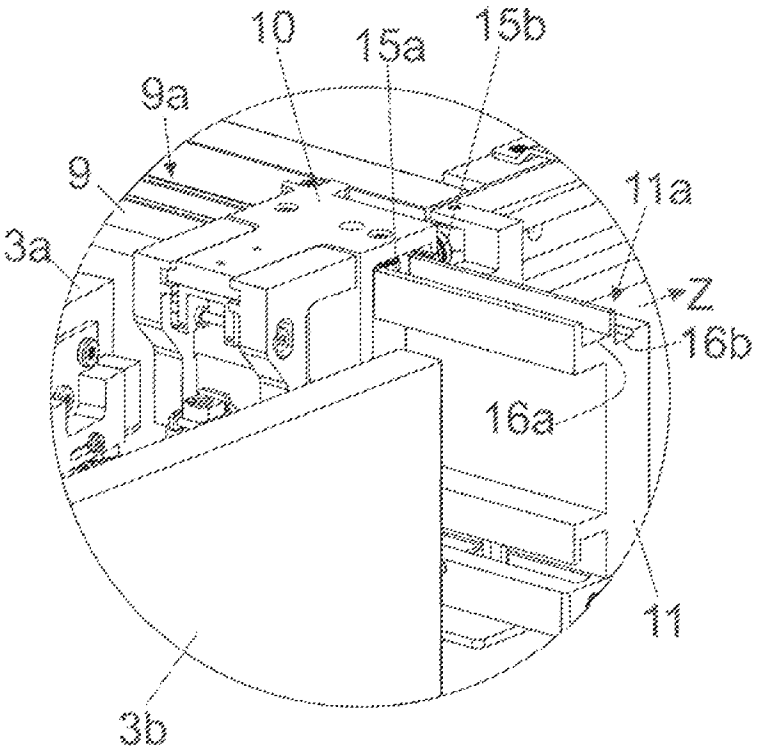
FIG. 1*a*, 1*b* show a guide system for moving furniture parts hingedly connected to one another, and an enlarged detail view thereof.
Figure 1A:
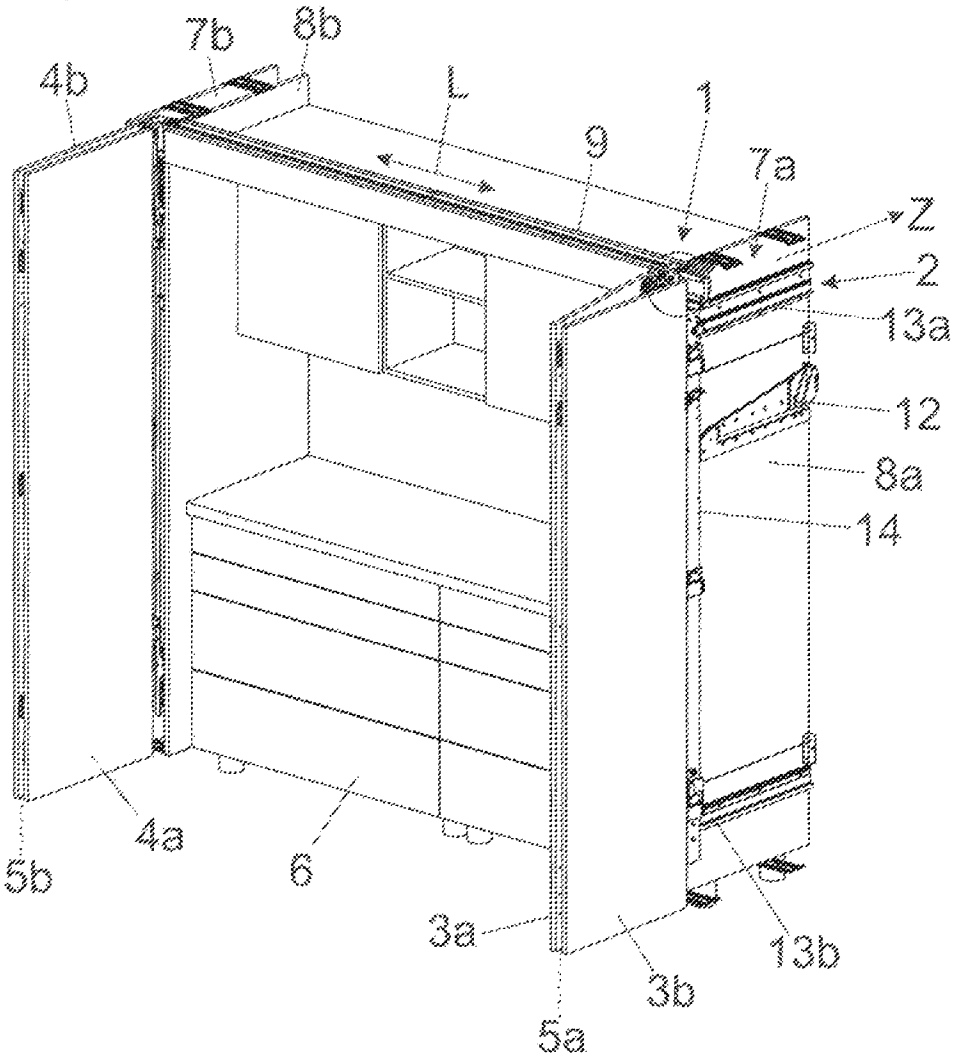

FIG. 1*a* shows a possible application of a guide system 2 having a rail arrangement 1 for guiding a first furniture part 3*a*, preferably in the form of a first door wing of a folding door. The first furniture part 3*a* is hingedly connected, in the mounting position, by a vertically extending axis 5*a* to a second furniture part 3*b* in the form of a second door wing. Optionally, at least two further furniture parts 4*a*, 4*b* may be provided which are also connected to one another by a vertically extending axis 5*b*. The guide system 2 may be used, for example, as a room partitioning system, so that in a living area, a furniture carcass 6 as shown in FIG. 1*a* in the form of a kitchen block, an office niche, a storage room, a shelf, etc. may entirely be covered by the furniture parts 3*a*, 3*b*; 4*a*, 4*b* and can be optically separated from the remaining space of the living area. The guide system 2 may also be used for cabinet systems, for example a walk-in closet. The functionality will be explained in the following with the aid of the furniture parts 3*a* and 3*b*, and the same applies to the furniture parts 4*a*, 4*b*.

The furniture parts 3*a*, 3*b* are movably supported by the guide system 2 between a first position, in which the furniture parts 3*a*, 3*b* are aligned substantially coplanar to one another and thereby cover the furniture carcass 6, and a second position, in which the furniture parts 3*a*, 3*b* are aligned parallel to one another. In the second position, the furniture carcass 6 is freely accessible for a person, and the two furniture parts 3*a*, 3*b* can be accommodated in a space-saving manner within an insertion compartment 7*a* arranged laterally besides the side wall 8*a* (the left insertion compartment 7*b* provided for the other furniture parts 4*a*, 4*b* is better visible in the drawing).

The rail arrangement 1 includes a first guide rail 9 having a longitudinal direction (L) for guiding the furniture parts 3*a*, 3*b*. For example, the guide rail 9 can be fixed to a ceiling of a room, to a wall of a room or also to a furniture carcass 6, preferably parallel to a front side of the furniture carcass 6.

FIG. 1*b* shows the encircled region of FIG. 1*a* is an enlarged view. The furniture parts 3*a*, 3*b* are connected to a guiding device 10 by which the furniture parts 3*a*, 3*b* are movably supported along the guide rail 9. Visible is a carrier 11 separate from the guide rail 9, and the carrier 11 is in the form of a displaceable slider which, in a transfer position, adjoins the guide rail 9 in a longitudinal direction (L) such that the guiding device 10 connected to the furniture part 3*a* can be transferred to and from between the guide rail 9 and the carrier 11. The guiding device 10 can have at least one first running wheel 15*a* with a vertical rotational axis for receiving lateral forces, and at least one second running wheel 15*b* with a horizontal rotational axis for receiving vertical forces. The running wheels 15*a*, 15*b* are configured to run along a profiled section 9*a* of the guide rail 9, and the profiled section 9*a* extends in the longitudinal direction (L). The carrier 11 also includes a profiled section 11*a* having a cross-section that corresponds with a form and size of the profiled section 9*a* in a cross-section, so that the guiding device 10 can be transferred to and from between the guide rail 9 and the carrier 11. For example, the carrier 11 can have at least two guide channels 16*a*, 16*b* extending in the longitudinal direction (L) for guiding the running wheels 15*a*, 15*b*.

The guiding device 10 configured to be linearly displaced along the guide rail 9, in the shown transfer position of the carrier 11, is still located on the guide rail 9. The carrier 11, in the transfer position, can be releasably locked to the guide rail 9 by a locking device 30 (FIG. 7*a*, 7*b*), and that locking can be released by a movement of the guiding device 10 in or on the carrier 11. After the carrier 11 has been unlocked, the carrier 11 can be moved—together with the guiding device 10 and the two furniture parts 3*a*, 3*b*—horizontally in a direction (Z) extending transversely, preferably at a right angle, to the longitudinal direction (L) of the guide rail 9 (corresponding to a direction (X)). The carrier 11 is connected to a vertically extending column 14 (i.e., a column extending in a direction (Y)) which is configured to be moved in the direction (Z) and the column 14 can be pulled at least over a region in the direction (Z) by a drive device 12. The column 14 is movably supported in the direction (Z) relative to second guide rails 13*a*, 13*b* which, in the mounted condition, are spaced from the first guide rail 9 in a height direction.

Figure 2B:
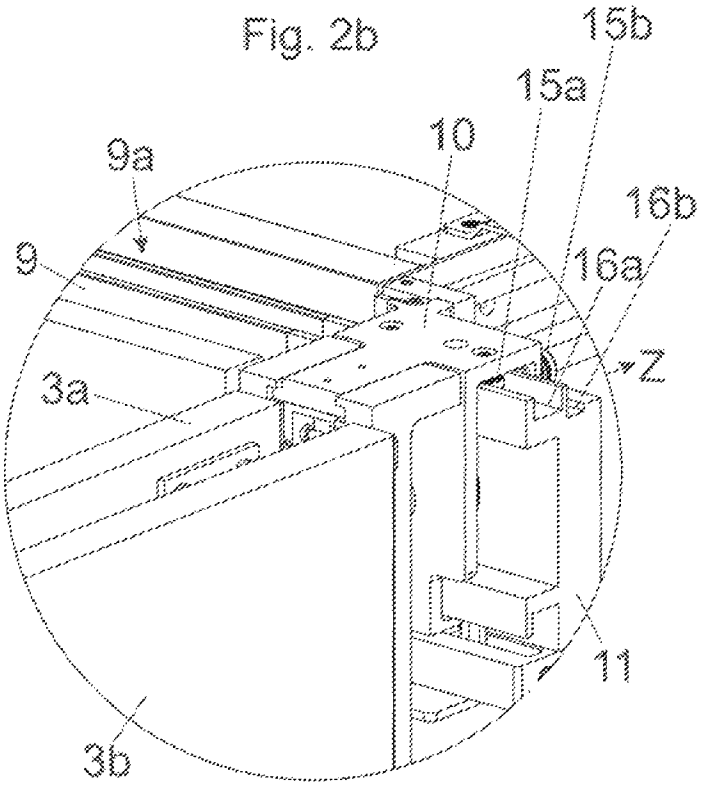
FIG. 2*a*, 2*b* show the guiding device located on the carrier, and an enlarged detail view thereof.
Figure 2A:
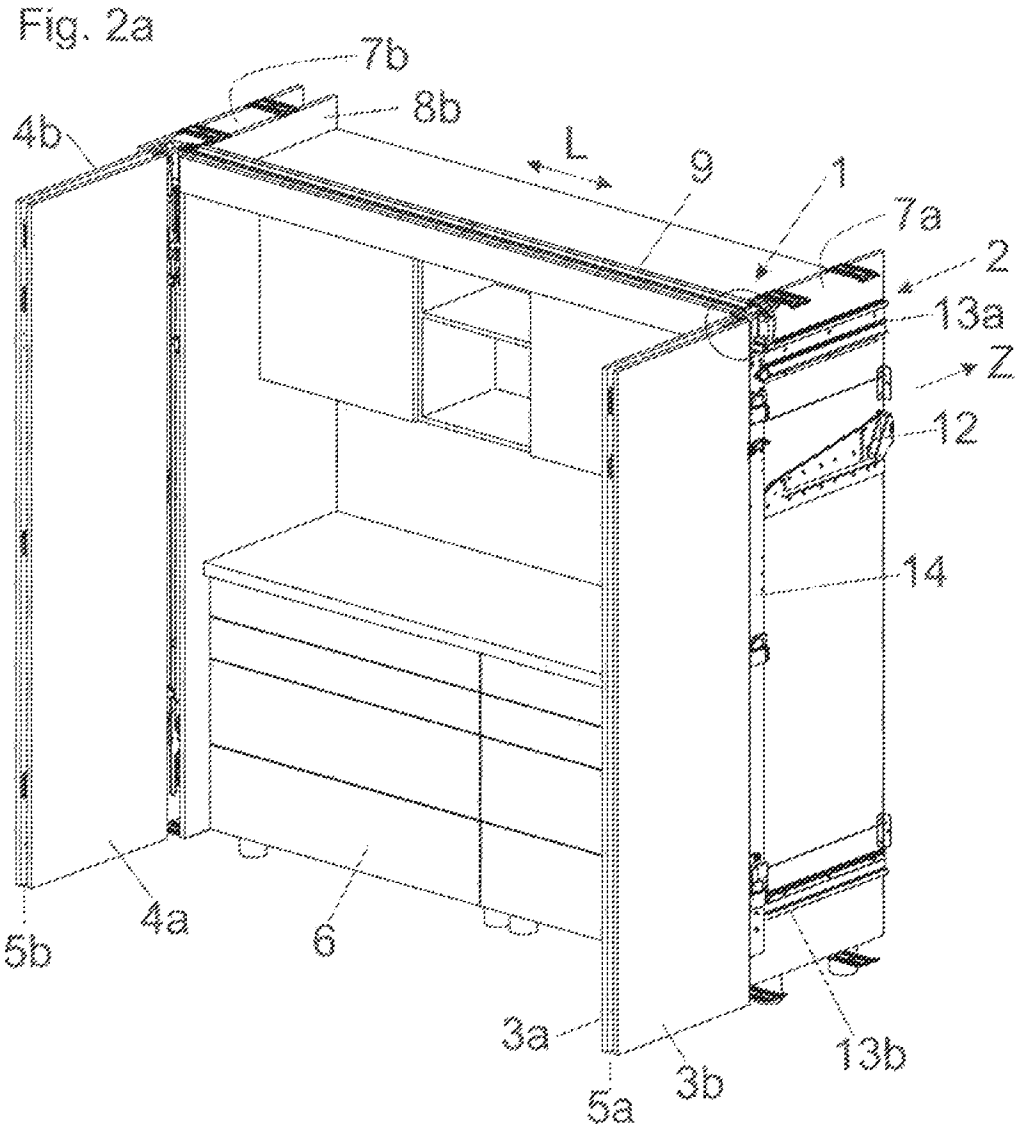

FIG. 2*a* shows the furniture parts 3*a* and 3*b*, after having been pivoted to one another starting from FIG. 1*a* about the vertical axis 5*a* and now adopt a substantially parallel position to one another. FIG. 2*b* shows the encircled region of FIG. 2*a* in an enlarged view, in which the guiding device 10 is now located on the carrier 11 being in the transfer position. A length of the carrier 11 measured in a longitudinal direction (L) can be greater than a width of the guiding device 10 measured in the longitudinal direction (L). Preferably, the profiled section 9*a* of the first guide rail 9 and the profiled section 11*a* of the carrier 11 are configured so as to be identical in a cross section and are aligned flush to one another in the transfer position, so that the running wheels 15*a*, 15*b* of the guiding device 10 can be moved between the first guide rail 9 and the carrier 11 without a disturbing abutting edge. Starting from the positon shown in FIG. 2*b*, the carrier 11, together with the guiding device 10 (and therewith the furniture parts 3*a*, 3*b*) can be moved by a force of the drive device 12 at least over a region in the direction (Z).

Figure 3A:
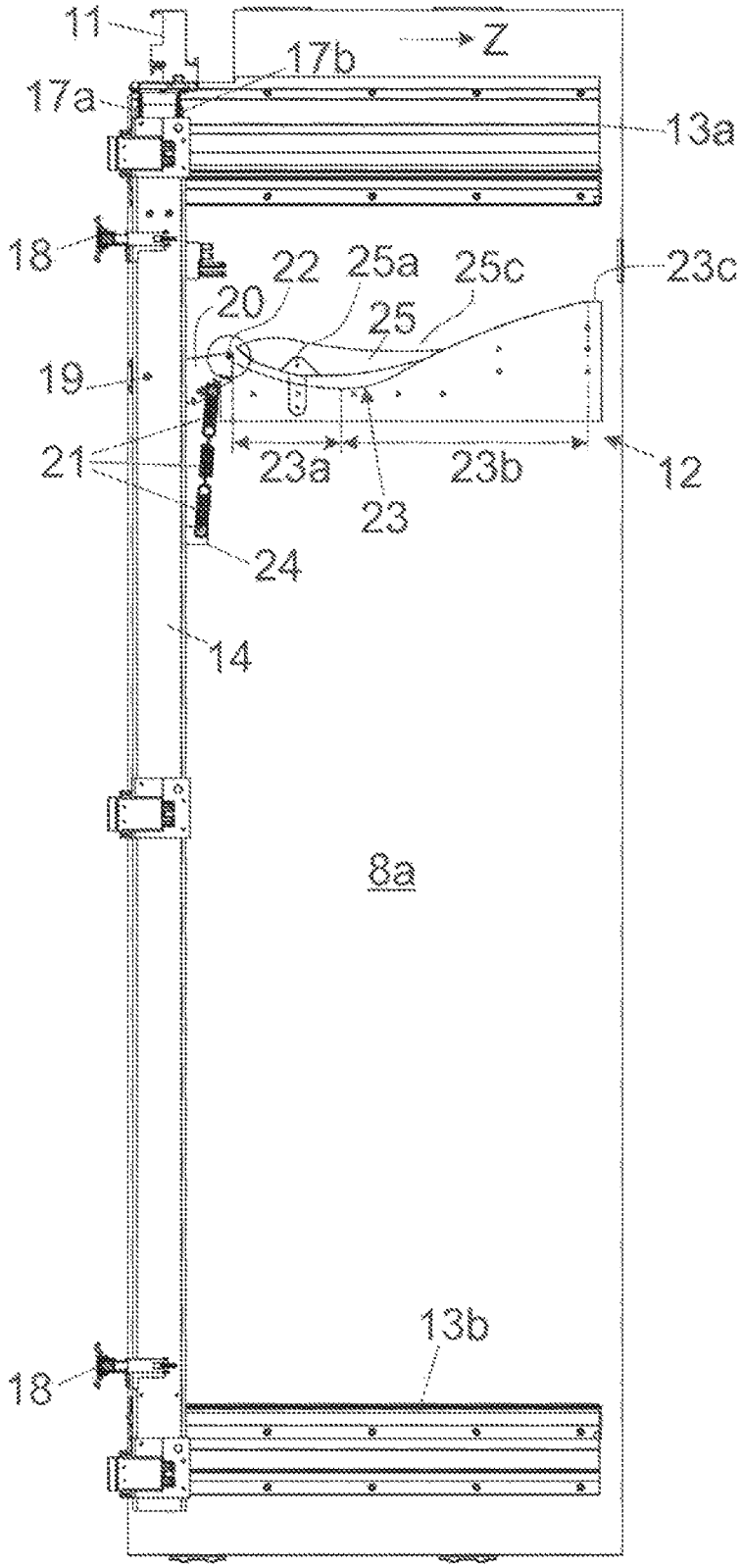
FIG. 3*a*, 3*b* are, respectively, a side view of the guide system, and an enlarged detail view thereof.
Figure 3B:
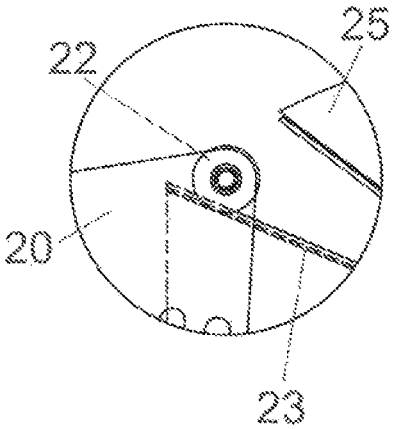

FIG. 3*a* shows a side view of the carrier 11 located in the transfer position, and the carrier 11 is connected to the vertically extending column 14. The column 14, together with the carrier 11, is displaceable in the direction (Z)—for example by supporting rollers 17*a*, 17*b*—along the second guide rails 13*a*, 13*b* fixed to the side wall 8*a*. Arranged on the column 14 is at least one fitting portion 18 for the movable support of the furniture part 3*b*, and a bearing portion 24 arranged stationarily relative to the column 14. At least one, preferably a plurality of, force storage member(s) 21 of the drive device 12 for retracting the furniture parts 3*a*, 3*b* in the direction (Z) is or are anchored to the bearing portion 24. Each of the force storage members 21, in the shown figure, are configured as tension springs engaging on an entrainment member 20 pivotally mounted about a pivoting axis 19 on the column 14. A pressure roller 22 is pivotally arranged on the entrainment member 20, and the pressure roller 22 can be pressed against a concave-shaped control curve 23 of the drive device 12 and can be displaced along the control curve 23 upon a movement of the column 14 in the direction (Z). The control curve 23 includes a retraction section 23*a* for partially retracting the carrier 11 in the direction (Z), and a tensioning section 23*b* adjoining the retraction section 23*a* for loading the force storage members 21. In FIG. 3*a*, the force storage members 21 are in a tensioned condition, so that the column 14 (and therewith the carrier 11), after unlocking of the carrier 11, can be retracted starting from the first guide rail 9 along the retraction section 23*a* by a force of the discharging force storage members 21 towards the lowest region of the control curve 23. In this way, the furniture parts 3*a*, 3*b* are also partially retracted into the insertion compartment 7*a*, whereby the furniture parts 3*a*, 3*b* are advantageously prepositioned for a continued movement into the insertion compartment 7*a* in the direction (Z). By a subsequent manual application of pressure to the furniture parts 3*a*, 3*b* when aligned parallel to one another, in the region of the pivoting axis 5*a*, the column 14 (and therewith the pressure roller 22) are further moved in the direction (Z) along the tensioning section 23*b* of the control curve 23, whereby the force storage members 21 are again loaded. When the pressure roller 22 of the entrainment member 20 reaches the end section 23*c* of the control curve 23, the force storage members 21 are fully loaded, so that the furniture parts 3*a*, 3*b* can be moved starting from a position in which the furniture parts 3*a*, 3*b* are fully inserted into the insertion compartment 7*a*, at least partially in a direction opposite the direction (Z) by the force storage members 21 upon an exit movement. Moreover, a movably-mounted switch member 25 with a setting contour 25*c* is provided, the switch member 25 being configured to be tilted about a pivoting axis 25*a*. The pressure roller 22 can be displaced, starting from the aforesaid inserted position, along the setting contour 25*c* of the switch member 25 upon a movement opposite the direction (Z). As a result, it is not necessary for the pressure roller 22, pressurized by the force storage members 21, to overcome the hindering retraction section 23*a* of the control curve 23 upon a movement in a direction opposite the direction (Z). Instead, the retraction section 23*a* can be bypassed by the pressure roller 22, and a force of the force storage members 21 can be maintained over a longer displacement path. FIG. 3*b* shows the region encircled in FIG. 3*a* in an enlarged view.

Figure 4A:
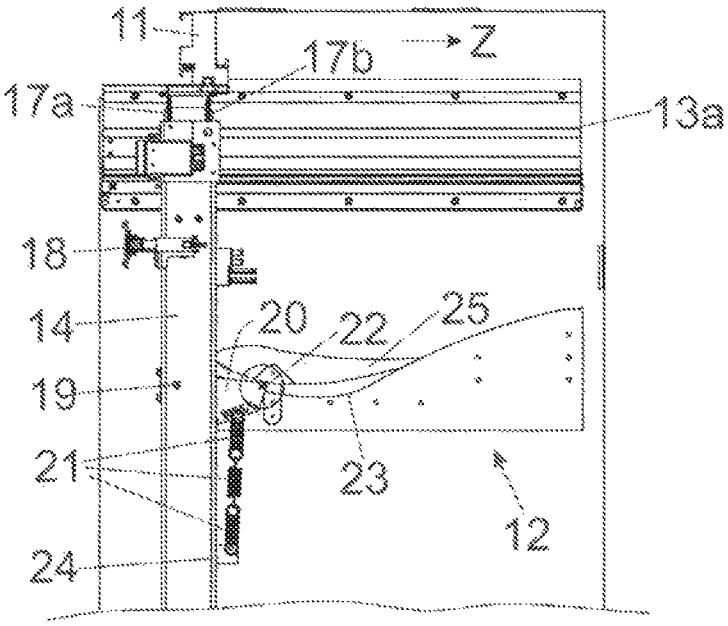
FIG. 4*a*-4*d* show the retraction process of the carrier in two subsequent positions, and enlarged detail views thereof.
Figure 4B:
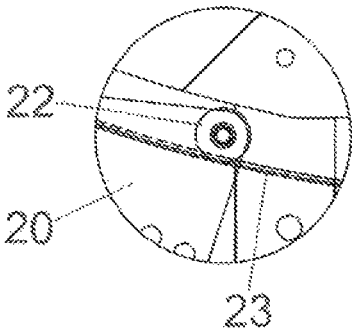
Figure 4C:
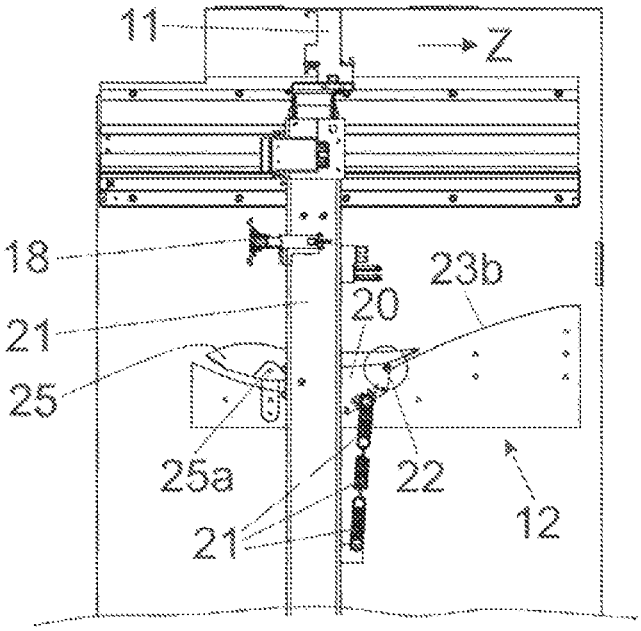
Figure 4D:
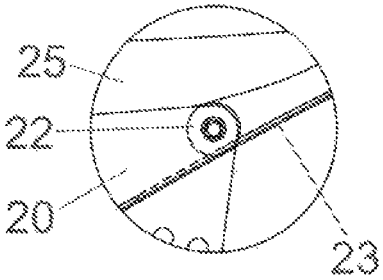

FIG. 4*a* shows a continued movement of the column 14 (and therewith of the carrier 11) in the direction (Z). Due to the reducing distance between the control curve 23 in the retraction section 23*a* (FIG. 3*a*) in relation to the bearing portion 24, the force storage members 21 are relaxed and thereby pull the column 14 and the carrier 11 in the direction (Z). FIG. 4*b* shows the region encircled in FIG. 4*a* in an enlarged view. When the pressure roller 22 reaches the lowest region of the control curve 23, the pressure roller 22 is moved onto the tensioning section 23*b* of the control curve 23 by applying a manual force to the furniture parts 3*a*, 3*b*, so that the force storage members 21 are again tensioned and, as a result, can be loaded. The switch member 25 configured to be tilted about the pivoting axis 25*a* is thereby lifted by the pressure roller 22 (FIG. 4*c*), so that the pressure roller 22 can pass the switch member 22 in an unhindered manner upon a movement in the direction (Z) and can further be moved along the tensioning section 23*b*. Due to the eccentric arrangement of the switch member 25 about the pivoting axis 25*a*, a two-armed lever with lever arms of different lengths is formed, so that the switch member 25 with the longer lever arm loosely rests, preferably exclusively loaded by the force of gravity, against the tensioning section 23*b* of the control curve 23. If appropriate, the switch member 25 can also be pressed against the control curve 23 by a spring element. FIG. 4*d* shows the region encircled in FIG. 4*c* in an enlarged view.

Figure 5A:
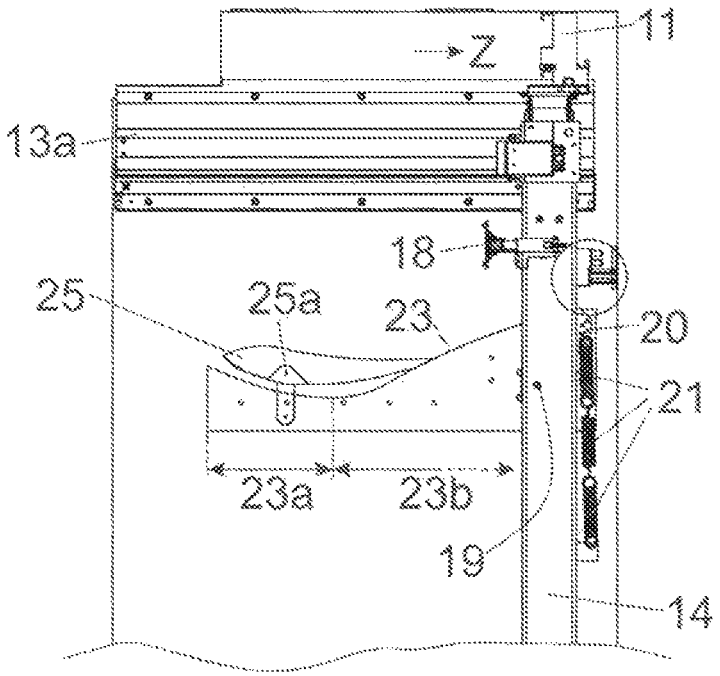
FIG. 5*a*-5*d* show continued positions of the carrier starting from FIG. 4*a*-4*d*, and enlarged detail views thereof.
Figure 5B:
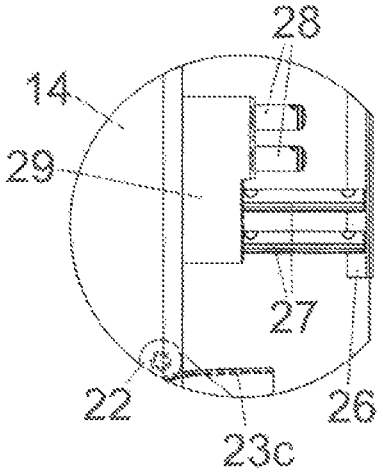

FIG. 5*a* shows the position of the column 14 right before reaching the fully inserted end position within the insertion compartment 7*a*. The pressure roller 22 has been moved along the tensioning section 23*b* of the control curve 23 and is located right before the horizontally extending end section 23*c* of the control curve 23, so that the column 14 is neither accelerated in the direction (Z) nor in a direction opposite the direction (Z). The force storage members 21 are thereby fully loaded. Arranged on the column 14 is a housing 29 in which a damping device 27 for dampening a closing movement of the column 14 and the carrier 11, respectively, is arranged. In the shown embodiment, the damping device 27 includes two, preferably hydraulic, linear dampers switched in a parallel relationship, and each of the linear dampers has a piston-cylinder-unit. These linear dampers, at the end of the closing movement of the column 14, are configured to hit against a stationary abutment portion 26, whereby the rams of the linear dampers are pressed-in and therewith the movement of the column 14 can be decelerated. Moreover, two ejection devices 28 are arranged in the housing 29, and each of the ejection devices 28 has a lockable energy storage member. The two rams of the ejection devices 28 cooperate with the abutment portion 26 upon a closing movement of the column 14, so that the energy storage members of the ejection devices 28 can be loaded and can be locked in a loaded condition. FIG. 5*b* shows the region encircled in FIG. 5*a* in an enlarged view.

Figure 5C:
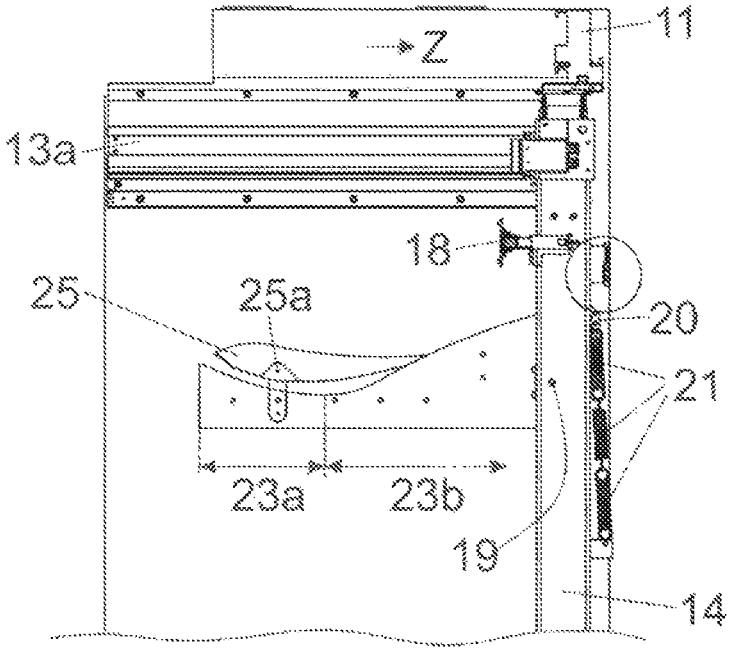
Figure 5D:
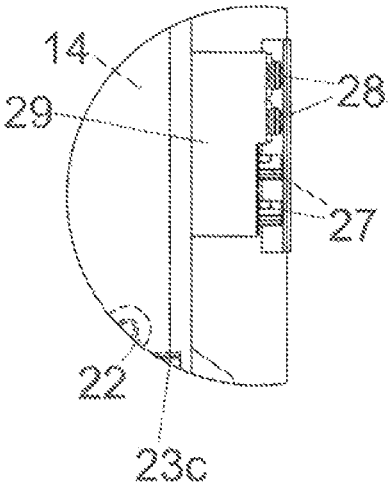

FIG. 5*c* shows the end position of the column 14, and the last closing movement of the column 14 has been decelerated by the damping device 27 and the lockable energy storage members of the ejection devices 28 are in a loaded condition. By overpressing the column 14, starting from its closed position into an overpressing position located behind the closed position, the ejection devices 28 can be moved into an unlocking position. In such a position, the column 14 can be again moved by a force of the ejection devices 28 and, subsequently, by the force of the loaded force storage members 21 in a direction opposite the direction (Z). FIG. 5*d* shows the region encircled in FIG. 5*c* in an enlarged view.

Figure 6A:
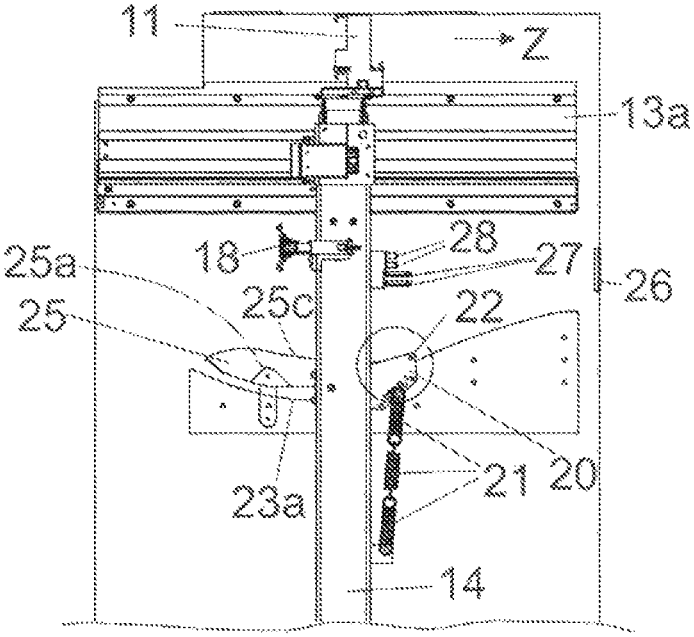
FIG. 6*a*-6*d* show the ejection process in two subsequent positions, and enlarged detail views thereof.
Figure 6B:
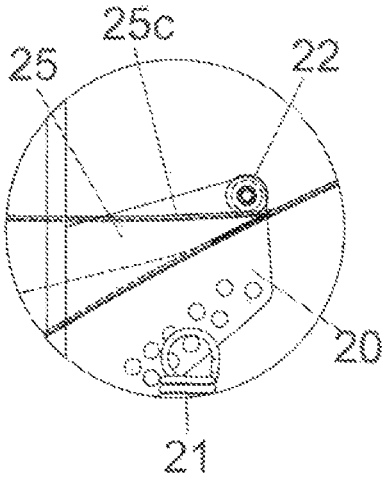

FIG. 6*a* shows a position of the column 14, after ejection of the ejection devices 28 in a direction opposite the direction (Z) has been performed. The pressure roller 22 is thereby located in a position entering the switch member 25, and the pressure roller 22, upon a movement in a direction opposite the direction (Z), is configured to be displaced no longer along the retraction section 23*a*, but along the setting contour 25*c* arranged or formed on the switch member 25. In this way, a smoothly running ejection operation of the column 14 and of the furniture parts 3*a*, 3*b*, respectively, can be brought about, without substantial oscillations in a force of the force storage members 21, and the force of the force storage members 21 can be maintained over a longer displacement path. FIG. 6*b* shows the region encircled in FIG. 6*a* in an enlarged view, in which the pressure roller 22 moves onto the setting contour 25*c* of the switch member 25 upon a movement of the column 14 in a direction opposite the direction (Z), without the pressure roller 22 needs to be displaced along the trough portion of the retraction section 23*a*.

Figure 6C:
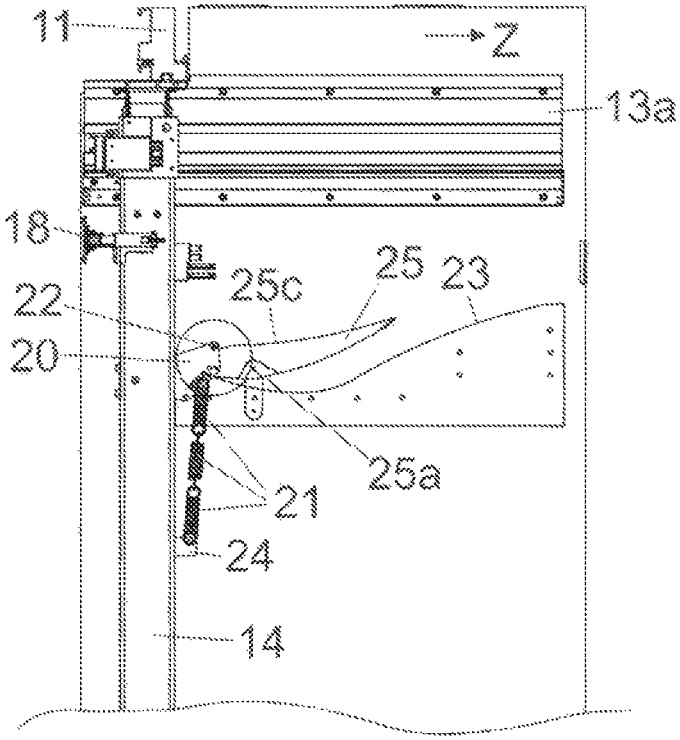
Figure 6D:
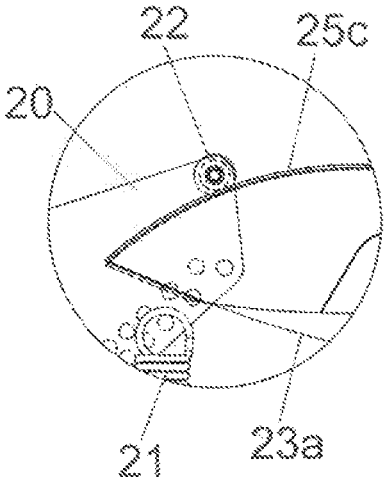

FIG. 6*c* shows a continued movement of the column 14 in a direction opposite the direction (Z), in which the pressure roller 22 has been moved along the setting contour 25*c* of the switch member 25 and in which the switch member 25 has been pivoted about the pivoting axis 25*a* in a counterclockwise direction. By this pivoting movement of the switch member 25 about the pivoting axis 25*a*, the pressure roller 22 is again returned to the initial region of the retraction section 23*a*. After the pressure roller 22 has again abandoned the setting contour 25*c* of the switch member 25, the switch member 25 pivots about the pivoting axis 25*a* back into its initial position, i.e. in that position in which the longer lever arm of the switch member 25, in turn, rests against the control curve 23 due to its heavier weight.

Figure 7A:
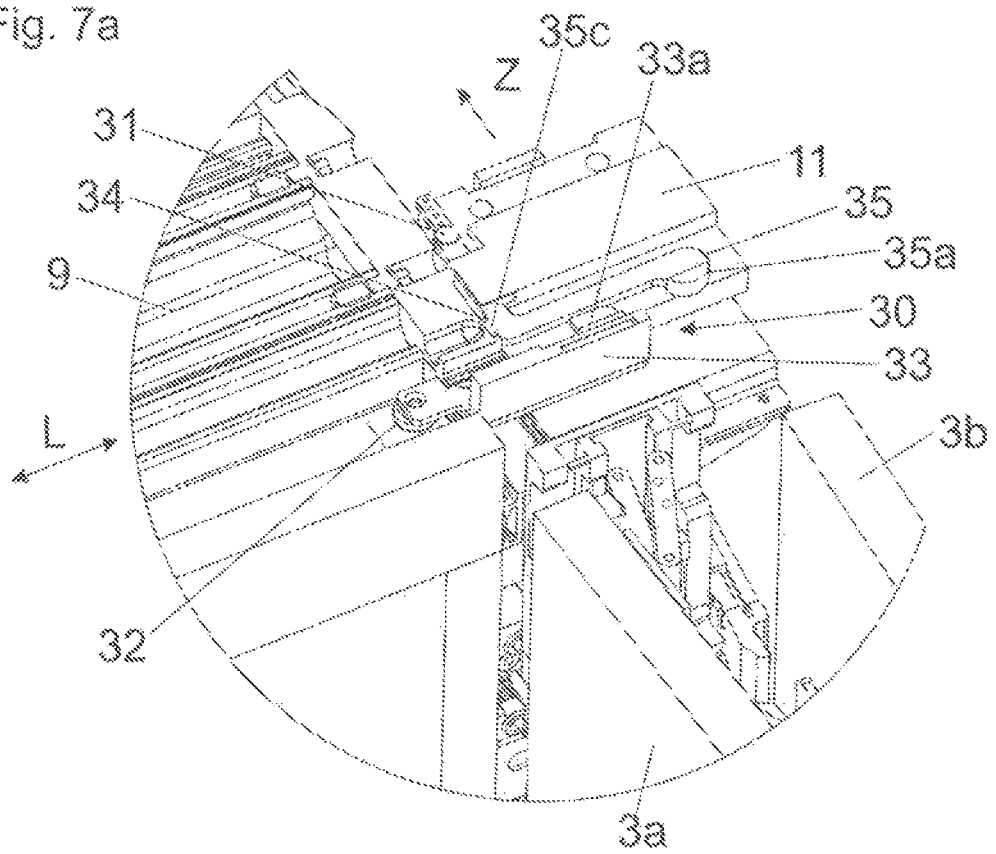
FIG. 7*a*, 7*b* show a possible embodiment for releasably locking between the carrier and the guide rail in two subsequent positions.
Figure 7B:
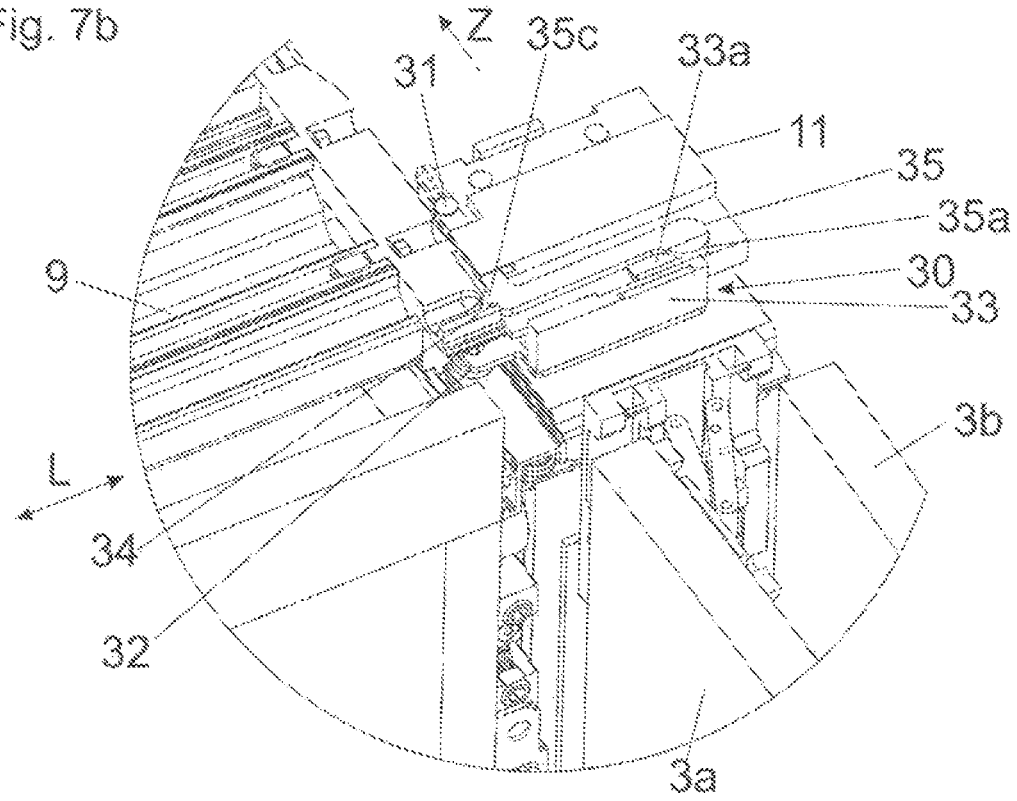

FIG. 7*a* and FIG. 7*b* show a possible embodiment of a locking device 30 for locking the carrier 11, in the transfer position or in a parking position, to the first guide rail 9, and the locking device 30 is configured to be unlocked by a movement of the guiding device 10 in or on the carrier 11. The first furniture part 3*a* is connected to the guiding device 10 configured to be moved in the longitudinal direction (L) along the first guide rail 9. A displacement piece 33 is motionally coupled to the guiding device 10, so that upon a movement of the guiding device 10 along the first guide rail 9, the displacement piece 33 also moves therewith. The displacement piece 33 has a protrusion 33*a* which, upon a movement in or on the carrier 11, is configured to cooperate with a counterstop 35*a* of a coupling lever 35 (FIG. 7*b*). The coupling lever 35 is pivotally mounted about a pivoting axis 31, and a locking element 35*c* can be moved by the coupling lever 35. The locking element 35*c* engages into a corresponding recess 34 of the first guide rail 9 in the locking position and thereby locks the carrier 11 relative to the first guide rail 9. The coupling lever 35, together with the locking element 35*c*, can have a one-piece configuration. The coupling lever 35 can be pre-stressed in a direction of the locking position by a spring (not shown), so that the carrier 11, upon a movement of the carrier 11 in a direction opposite the direction (Z), can be automatically locked by a force of that spring to the first guide rail 9, and the guiding device 10 can be again transferred back starting from the carrier 11 to the first guide rail 9.

Figure 8A:
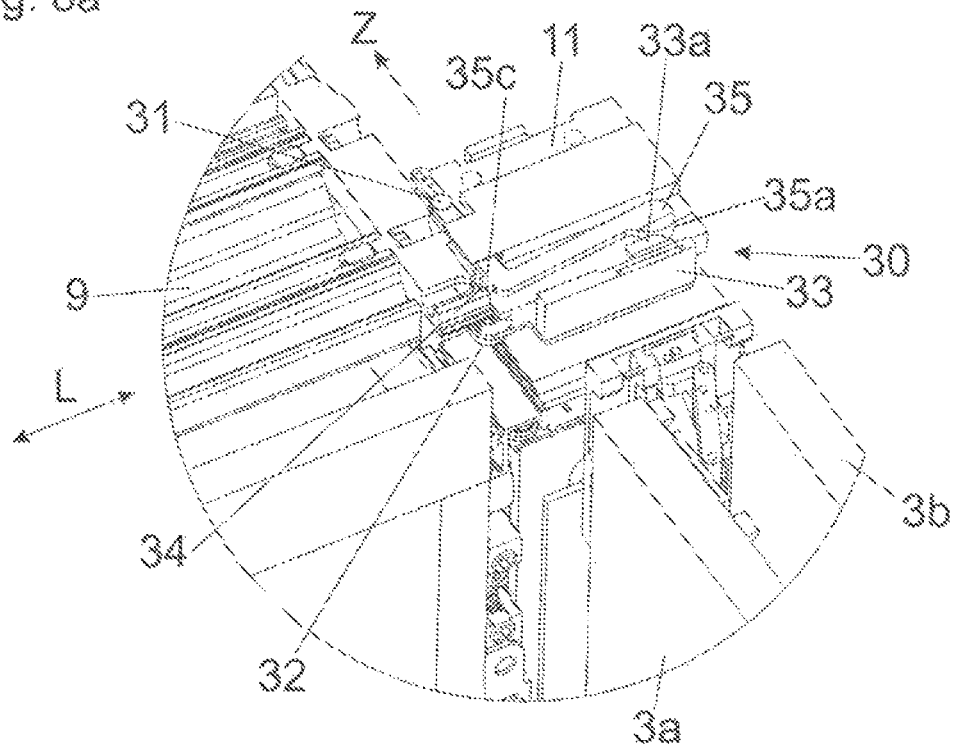
FIG. 8*a*, 8*b* show continued positions starting from FIG. 7*a*, 7*b*, FIG. 9*a*, 9*b* show an item of furniture with the movable furniture parts in a first position and in a second position.
Figure 8B:
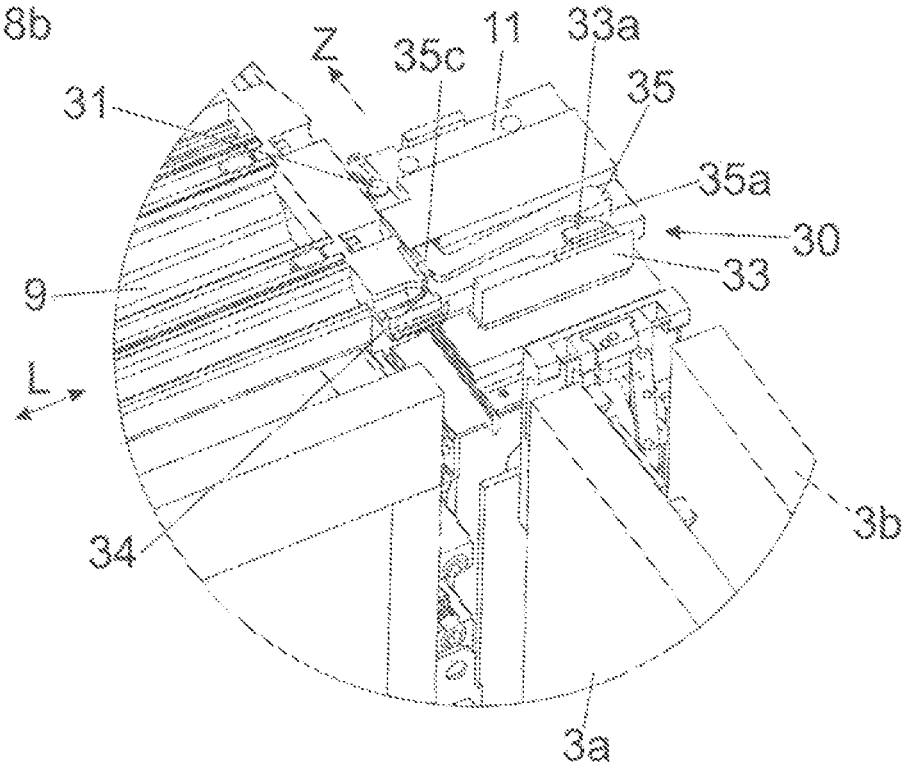

FIG. 8*a* and FIG. 8*b* show a continued movement of the displacement piece 33 in the longitudinal direction (L), the displacement piece being motionally coupled to the guiding device 10. The protrusion 33*a* of the displacement piece 33 cooperates with the counterstop 35*a* of the coupling lever 35, and therewith pivots the coupling lever 35 about the pivoting axis 31. As a result, the locking element 35*c* is moved out from the recess 34 of the first guide rail 9, and the carrier 11 is released relative to the first guide rail 9 in order for a movement in the direction (Z) to be enabled. After unlocking has been effected, the carrier 11—together with the column 14—can be retracted at least partially in the direction (Z) by a force of the force storage members 21 of the above-described first drive device 12, and a spacing roller 32 pivotally mounted to the displacement piece 33 for laterally guiding the carrier 11 in a the direction (Z) is configured to run along the side wall 8*a*.

Figure 9A:
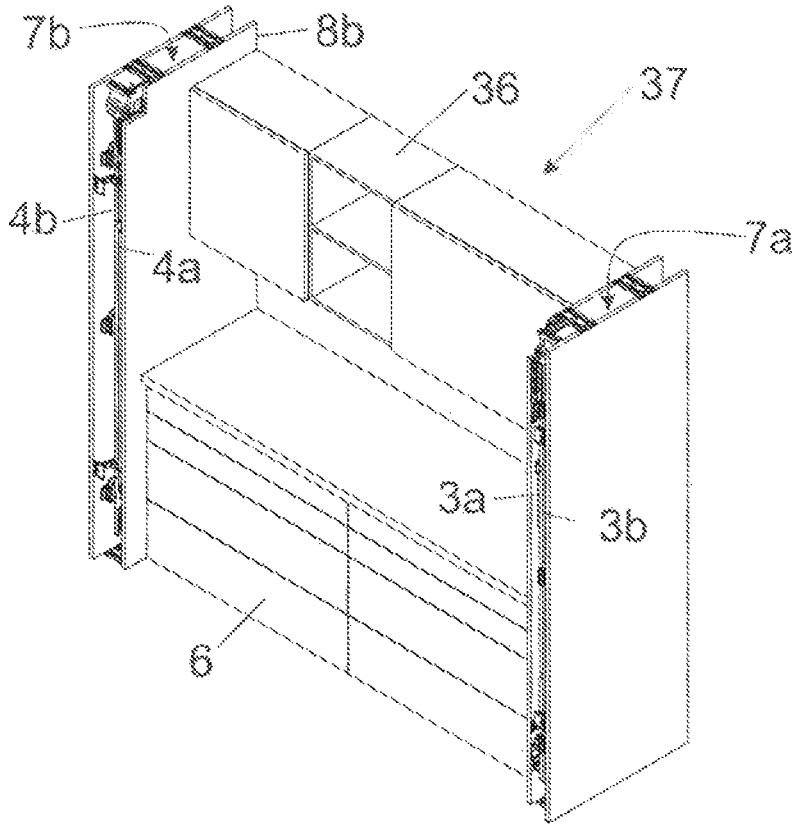
Figure 9B:
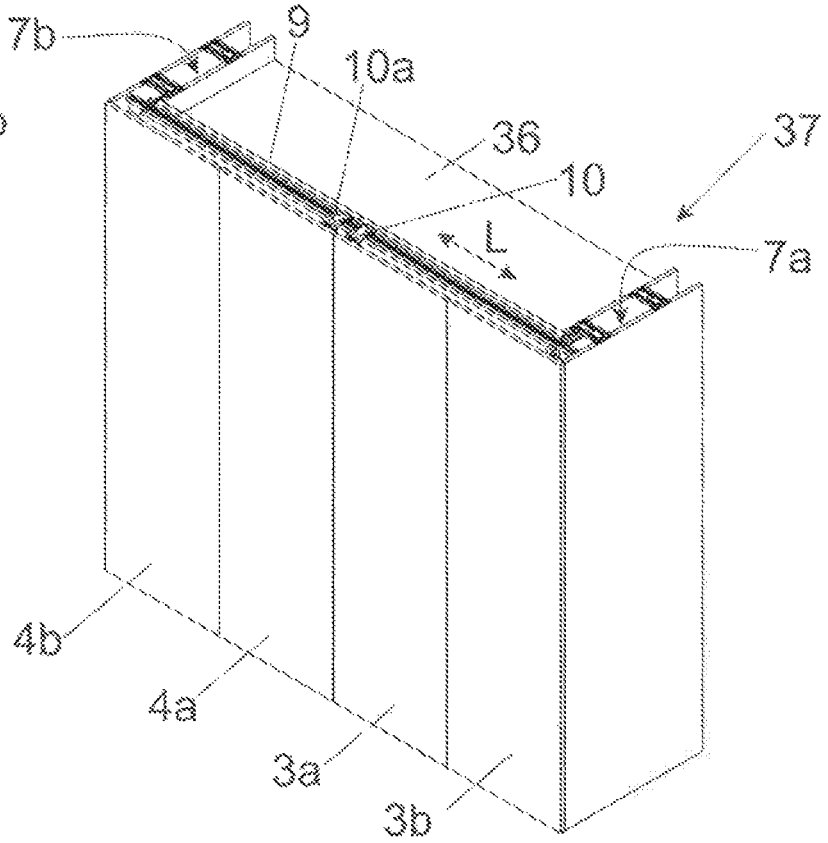

FIG. 9*a* and FIG. 9*b* show an item of furniture 37 according to FIG. 1*a*, the item of furniture 37 comprises a furniture carcass 36 being stationary during operation and at least two furniture parts 3*a*, 3*b*, in particular door wings of a folding door, movably-mounted relative to the furniture carcass 36. The furniture parts 3*a*, 3*b*, in the mounted position, are hingedly connected to one another by a vertically extending pivoting axis 5*a*. The at least two furniture parts 3*a*, 3*b* are capable of being moved by the guide system 2 between a first position, in which the furniture parts 3*a*, 3*b* are aligned substantially coplanar to each other (FIG. 9*b*), and a second position, in which the furniture parts 3*a*, 3*b* are aligned substantially parallel to each other (FIG. 9*a*). The item of furniture 37 can have at least one lateral insertion compartment 7*a*, 7*b* in which the furniture parts 3*a*, 3*b* can be accommodated in the second position. In the shown figure, at least one further furniture carcass 6 is provided which is inserted into the furniture carcass 36 or which is connected to the furniture carcass 36, and the further furniture carcass 6 can be covered by the movable furniture parts 3*a*, 3*b*, 4*a*, 4*b* in the first position and is accessible in the second position. The furniture parts 3*a*, 3*b* can be displaced along the first guide rail 9 by the guiding device 10, while the furniture parts 4*a*, 4*b* are movable along the same guide rail 9 by a separate guiding device 10*a*.

Figure 10A:
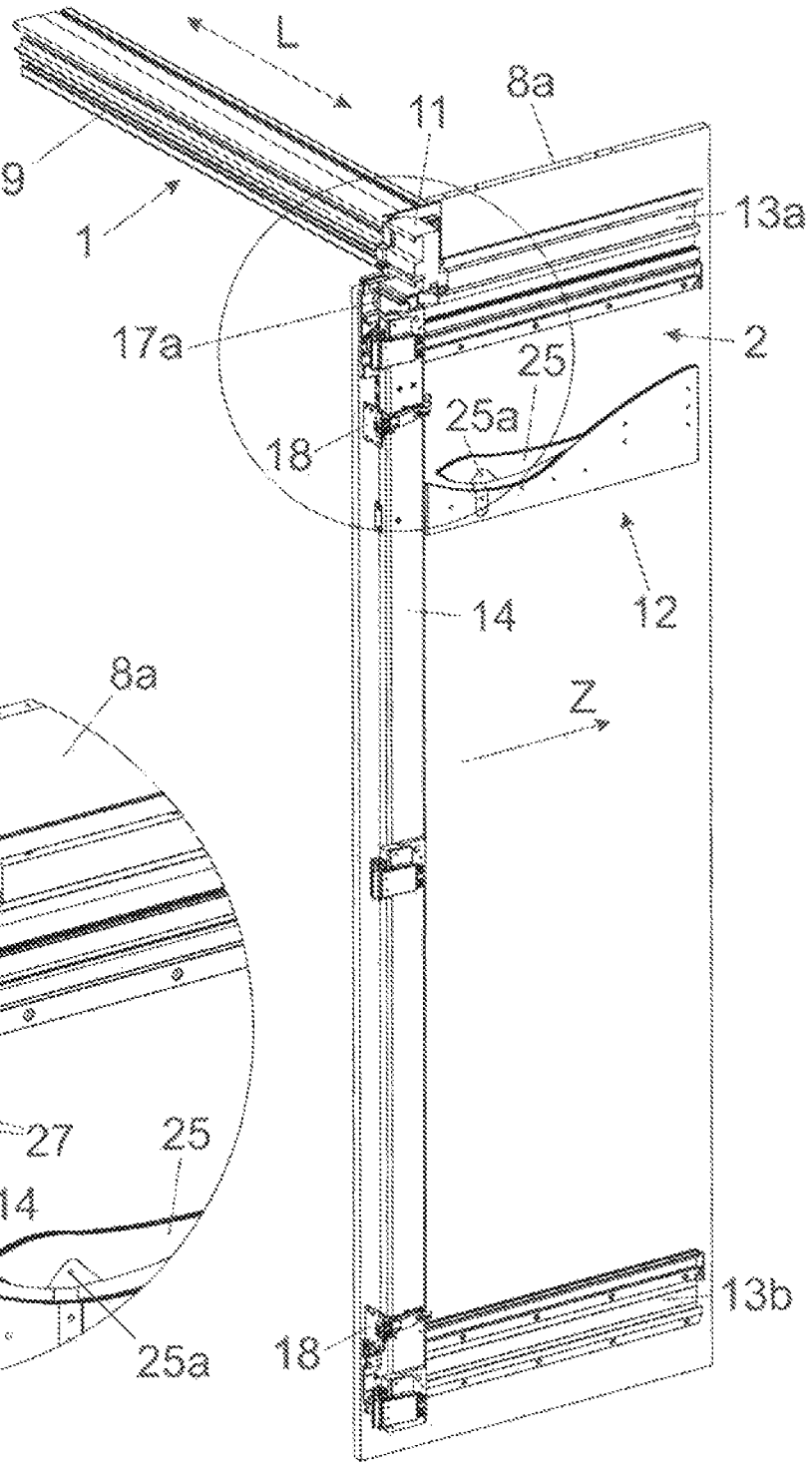
FIG. 10*a*, 10*b* show the guide system with the carrier in a first position, and an enlarged detail view thereof.

FIG. 10*a* shows the rail arrangement 1 of the guide system 2, in which the carrier 11 can be locked to the first guide rail 9 by the described locking device 30, and the carrier 11 can be moved from the transfer position in a direction (Z) extending transversely to the longitudinal direction (L). On the side wall 8*a*, which can partially form the insertion compartment 7*a*, second guide rails 13*a* and 13*b* are fixed which are provided for the displaceable support of the column 14 connected to the carrier 11, and fixed to the side wall 8*a* is the drive device 12 with the switch member 25 pivotally mounted about the pivoting axis 25*a*.

Figure 10B:
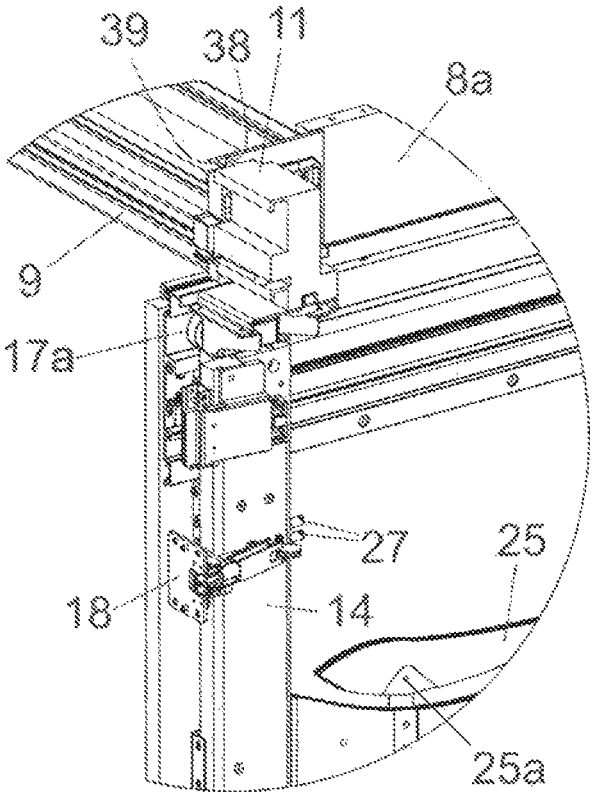

FIG. 10*b* shows the region encircled in FIG. 10*a* in an enlarged view, in which the carrier 11 has been moved out from the transfer position and has slightly been moved in the direction (Z). For limiting a movement of the carrier 11 in a direction opposite the direction (Z), at least one abutment element 38 is provided on the carrier 11. The abutment element 38 is configured to hit against a counterstop 39 of the first guide rail 9, whereby a further movement of the carrier 11 in a direction opposite the direction (Z) can be prevented. For guiding the carrier 11 and the column 14, respectively, at least one supporting roller 17*a* can be provided which is configured to run along a running limb arranged or formed on the second guide rail 13*a*. Visible is the damping device 27 arranged on the column 14, the damping device 27 is provided for dampening a movement of the column 14 within an end position range being remote from the transfer position.

Figure 11A:
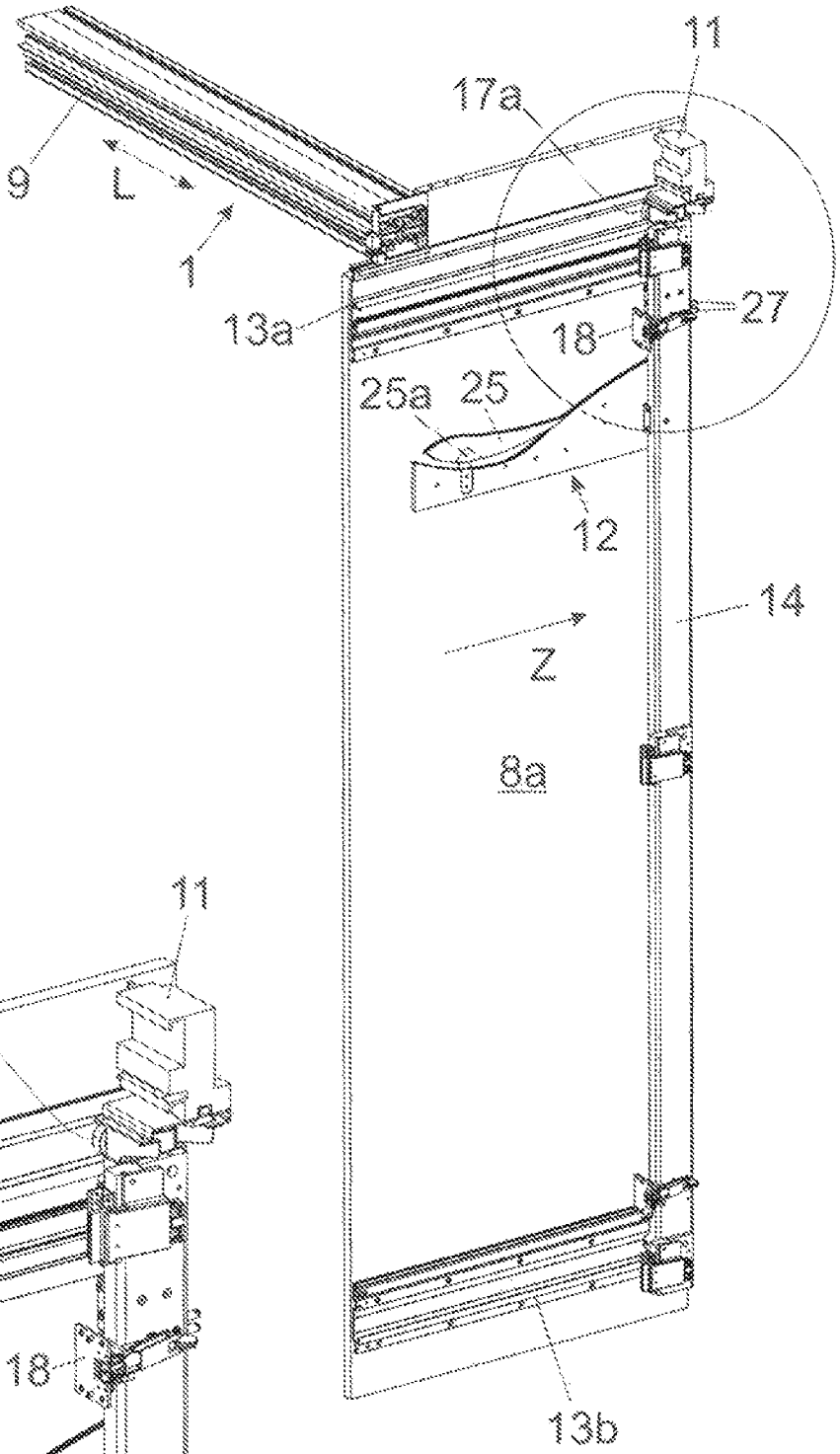
FIG. 11*a*, 11*b* show the guide system with the carrier in a second position, and an enlarged detail view thereof.
Figure 11B:
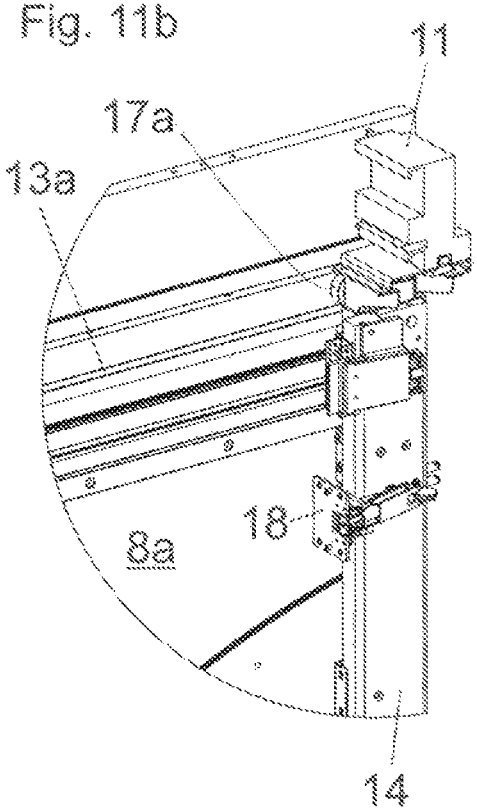

FIG. 11*a* shows the carrier 11 in a position remote from the first guide rail 9, the position corresponding to a position of the furniture parts 3*a*, 3*b* when fully inserted into the insertion compartment 7*a*. Starting from the position shown in FIG. 11*a*, the furniture parts 3*a*, 3*b* can be moved in a direction opposite the direction (Z) by the ejection devices 28 (not shown here). FIG. 11*b* shows the region encircled in FIG. 11*a* in an enlarged view.

Figure 12A:
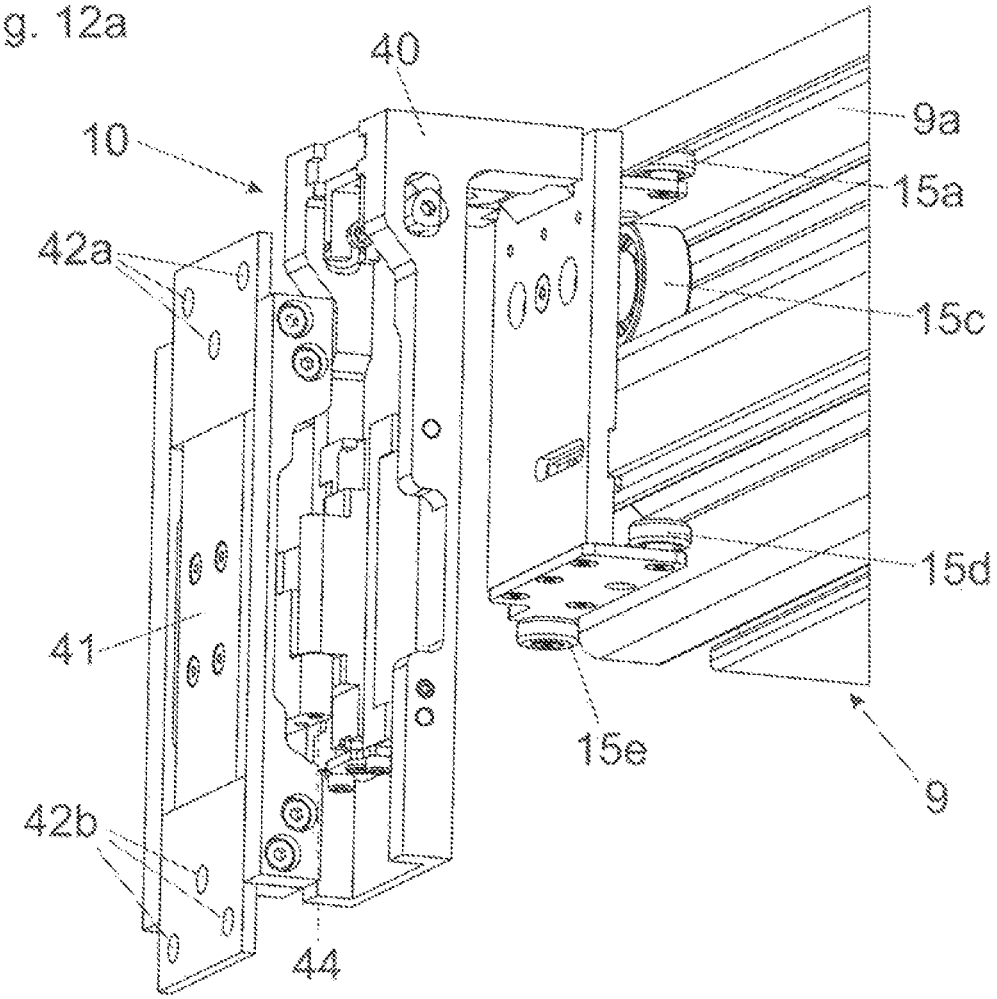
FIG. 12*a*, 12*b* show the guiding device movably-supported on the guide rail in a perspective view and in a cross-sectional view.

FIG. 12*a* shows a perspective view the guiding device 10 configured to be movably supported on the first guide rail 9. The guiding device 10 can include a plurality of running wheels 15*a*, 15*c*, 15*d*, 15*e* with vertically and with horizontally extending rotational axes, and the running wheels 15*a*, 15*c*, 15*d*, 15*e* are configured to run along a profiled section 9*a* of the first guide rail 9. The guiding device 10 has a holding arm 40, and the fitting portion 41 to be fixed to the furniture part 3*a* is connected to the holding arm 40 by a vertically extending pivoting axis in the mounting position. The fitting portion 41 includes a plurality of fastening locations 42*a*, 42*b* for fixing to the furniture part 3*a*.

Figure 12B:
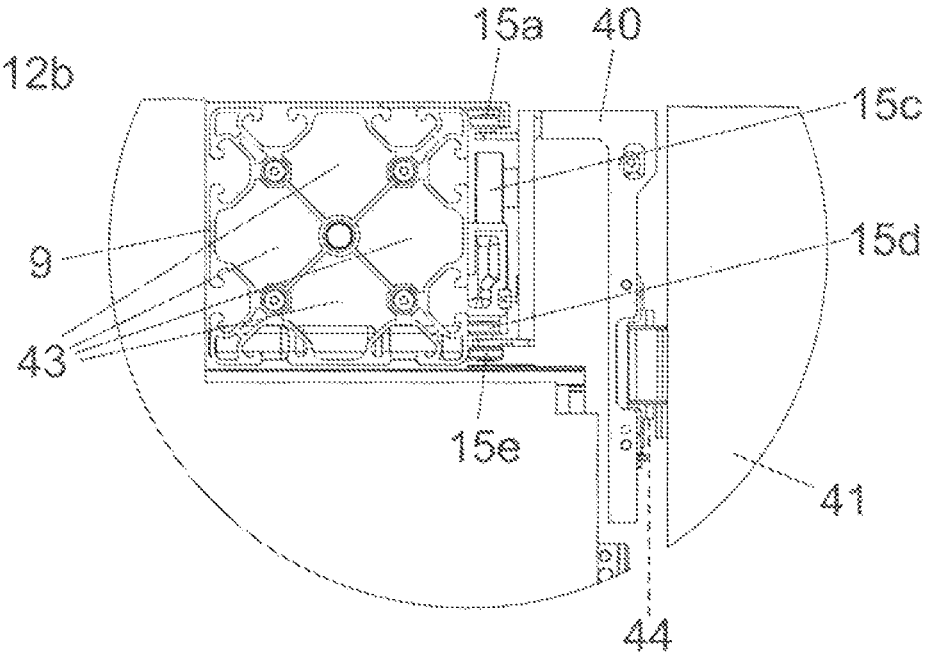

FIG. 12*b* shows a cross-sectional view of the guiding device 10 configured to be movably supported on the first guide rail 9. The first guide rail 9, in a cross-section, has a plurality of cavities 43 which are separated from each other by profiled limbs. The running wheels 15*a*, 15*c*, 15*d*, 15*e* are configured to run along the first guide rail 9, and the fitting portion 41 to be fixed to the furniture part 3*a* is pivotally connected to the holding arm 40 by the vertically extending pivoting axis 44.

LIST OF REFERENCES

1 rail arrangement
2 guide system
3*a*, 3*b* furniture parts
4*a*, 4*b* furniture parts
5*a*, 5*b* vertical pivoting axes
6 furniture carcass
7*a*, 7*b* insertion compartments
8*a*, 8*b* side walls
9 first guide rail
9*a* profiled section of first guide rail
10 guiding device
11 carrier
11*a* profiled section of carrier
12 drive device
13*a*, 13*b* second guide rails
14 column
15*a*, 15*b*, 15*c*, 15*d*, 15*e* running wheels
16*a*, 16*b* guide channels
17*a*, 17*b* supporting rollers
18 fitting portion
19 pivoting axis of entrainment member
20 entrainment member
21 force storage member
22 pressure roller
23 control curve
23*a* retraction section of control curve
23*b* tensioning section of control curve
23*c* end section of control curve
24 bearing portion
25 switch member
25*a* pivoting axis of switch member
25*c* setting contour of switch member
26 stationary abutment portion
27 damping device
28 ejection devices
29 housing
30 locking device
31 pivoting axis of coupling lever
32 spacing roller
33 displacement piece
33*a* protrusion of displacement piece
34 recess of first guide rail
35 coupling lever
35*a* counterstop of coupling lever
35*c* locking element of coupling lever
36 furniture carcass
37 item of furniture
38 abutment element of carrier
39 counterstop of first guide rail
40 holding arm of guiding device
41 fitting portion of guiding device
42*a*, 42*b* fastening locations of guiding device
43 cavities of first guide rail
44 pivoting axis of fitting portion
45 crossing region

The invention claimed is:

1. A guide system for guiding a movably-supported first furniture part hingedly connected to at least one second furniture part, the guide system comprising:

a first guide rail for guiding the furniture parts;

a second guide rail for guiding the furniture parts, wherein the second guide rail extends transversely relative to the first guide rail in a mounted position;

a guiding device to be connected to one of the furniture parts, the guiding device being movable relative to the first guide rail and the second guide rail and configured to be transferred in a crossing region between the first guide rail and the second guide rail, the crossing region being a region where a longitudinal axis of the first guide rail intersects a longitudinal axis of the second guide rail when viewed from above;

a drive device including an entrainment member to be acted upon by at least one force storage member, the entrainment member being releasably coupled to the guiding device, the entrainment member being configured to be locked in a parking position and unlocked by entry of the guiding device into the crossing region such that the entrainment member and the guiding device coupled therewith are retractable in a direction from the crossing region along the second guide rail by a force of the at least one force storage member; and a pressure roller rotatably arranged on the entrainment member, the pressure roller being configured to be pressurized against a control curve by the force of the at least one force storage member, wherein the pressure roller is configured to run in or along the control curve upon a movement of the guiding device along the second guide rail;

wherein the first guide rail and the second guide rail are spaced from each other in a height direction in the mounted position.

2. The guide system according to claim 1, wherein the control curve includes a retraction section along which the entrainment member is to be retracted along the second guide rail by the force of the at least one force storage member, and a tensioning section adjoining the retraction section and along which the at least one force storage member are to be loaded upon a continued movement of the entrainment member in the retraction direction.

3. The guide system according to claim 2, further comprising a switch member having a setting contour formed or arranged on the switch member, wherein the pressure roller is configured to run along the setting contour of the switch member upon a movement of the entrainment member in a direction opposite the retraction direction so as to bypass the retraction section of the control curve.

4. The guide system according to claim 1, wherein the guide system includes a column vertically extending in the mounted position, the column being configured to be moved along the second guide rail with the guiding device, wherein the entrainment member is configured to pivot about a pivoting axis on the column.

5. The guide system according to claim 4, wherein at least one fitting portion is arranged on the column to movably support one of the furniture parts.

6. The guide system according to claim 4, wherein the column is connected to a carrier configured to be moved, in the mounted position, into a transfer position in which the carrier adjoins the first guide rail in a longitudinal direction such that the guiding device is transferable between the first guide rail and the carrier.

7. The guide system according to claim 1, wherein the guiding device is a slider having at least one running wheel configured to run along the first guide rail.

8. The guide system according to claim 1, wherein the guiding device extends along the longitudinal axis of the first guide rail or is parallel to the first guide rail.

9. The guide system according to claim 1, wherein the guiding device is configured to move along the first guide rail to move the first furniture part and the second furniture part into a first position, in which the first furniture part and the second furniture part are aligned substantially coplanar to one another along the first guide rail.

10. An arrangement comprising:

furniture parts including a first furniture part and a second furniture part hingedly connected to the first furniture part by a pivoting axis, and the guide system according to claim 1 for guiding the furniture parts.

11. The arrangement according to claim 10, wherein the furniture parts are configured to achieve a first position, in which the furniture parts are spread apart from each other, and a second position, in which the furniture parts are folded together, wherein the first guide rail is configured to guide the furniture parts in the first position, and the second guide rail is configured to guide the furniture parts in the second position, wherein the furniture parts, upon a transition from the first guide rail to the second guide rail, are retractable along the second guide rail by the force of the least one force storage member.

12. An item of furniture comprising the arrangement according to claim 10.

13. The item of furniture according to claim 12, further comprising a furniture carcass stationary during operation, wherein the furniture parts include door wings of a folding door movable relative to the furniture carcass, the furniture parts being hingedly connected to one another by a vertically extending pivoting axis in the mounting position, wherein the furniture parts are movable by the guide system between a first position, in which the furniture parts are aligned substantially coplanar to one another, and a second position, in which the furniture parts are aligned substantially parallel to one another.

14. The item of furniture according to claim 13, further comprising a lateral insertion compartment in which the furniture parts are to be accommodated in the second position.

15. The item of furniture according to claim 13, wherein the furniture carcass is a first furniture carcass, the item of furniture further comprising a second furniture carcass inserted into the first furniture carcass or connected to the first furniture carcass, wherein the second furniture carcass is configured to be covered by the movable furniture parts in the first position and is accessible in the second position.

16. A guide system for guiding a movably-supported first furniture part hingedly connected to at least one second furniture part, the guide system comprising:

a first guide rail for guiding the furniture parts;

a second guide rail for guiding the furniture parts, wherein the second guide rail extends transversely relative to the first guide rail in a mounted position;

a guiding device to be connected to one of the furniture parts, the guiding device being movable relative to the first guide rail and the second guide rail and configured to be transferred in a crossing region between the first guide rail and the second guide rail, the crossing region being a region where a longitudinal axis of the first guide rail intersects a longitudinal axis of the second guide rail when viewed from above; and a drive device including an entrainment member to be acted upon by at least one force storage member, the entrainment member being releasably coupled to the guiding device, the entrainment member being configured to be locked in a parking position and unlocked by entry of the guiding device into the crossing region such that the entrainment member and the guiding device coupled therewith are retractable in a direction from the crossing region along the second guide rail by a force of the at least one force storage member;

wherein the first guide rail and the second guide rail are spaced from each other in a height direction in the mounted position, wherein the guide system includes a column vertically extending in the mounted position, the column being configured to be moved along the second guide rail with the guiding device, wherein the entrainment member is configured to pivot about a pivoting axis on the column, wherein the column is connected to a carrier configured to be moved, in the mounted position, into a transfer position in which the carrier adjoins the first guide rail in a longitudinal direction such that the guiding device is transferable between the first guide rail and the carrier, wherein the carrier is configured to be releasably locked to the first guide rail by a locking device, and the locking device is configured to be unlocked upon a movement of the guiding device in or on the carrier.

* * * * *